US008595901B1

(12) United States Patent
Shaw et al.

(10) Patent No.: US 8,595,901 B1
(45) Date of Patent: Dec. 3, 2013

(54) HINGE ASSEMBLY WITH AN ADJUSTABLE PIVOT

(71) Applicant: Ventra Group, Inc., Bradford (CA)

(72) Inventors: David W. Shaw, Richmond Hill (CA); Joaquin Hung, Markham (CA); Dan Gidden, Bradford (CA); Bradley F. Patzer, Barrie (CA)

(73) Assignee: Ventra Group, Inc., Bradford, Ontario (CA)

( * ) Notice: Subject to any disclaimer, the term of this patent is extended or adjusted under 35 U.S.C. 154(b) by 0 days.

(21) Appl. No.: 13/667,076

(22) Filed: Nov. 2, 2012

(51) Int. Cl.
*E05D 7/04* (2006.01)

(52) U.S. Cl.
USPC ..... 16/235; 16/254; 180/69.2; 296/193.11; 296/76; 296/50

(58) Field of Classification Search
USPC ..... 16/235, 254, 366, 368–370; 180/69.2, 180/69.21; 296/193.11, 76, 146.8, 146.11, 296/50, 56, 57.1
See application file for complete search history.

(56) References Cited

U.S. PATENT DOCUMENTS 2,000,172 A 5/1935 Hason
4,893,863 A * 1/1990 Skonieczny et al. ..... 296/76
5,029,930 A * 7/1991 Ihrke et al. ..... 296/76
5,074,609 A * 12/1991 Dear ..... 296/76
5,584,099 A * 12/1996 Westerdale ..... 16/245
5,687,453 A 11/1997 Megregian et al.
5,765,895 A 6/1998 Rose et al.
5,967,586 A * 10/1999 Duffy et al. ..... 296/76
6,382,704 B1 * 5/2002 Nastasoiu ..... 296/146.11
6,701,572 B2 * 3/2004 Bechthold ..... 16/235
7,089,626 B2 8/2006 Alexander
7,774,900 B2 8/2010 Shaw
8,020,918 B2 9/2011 Patzer et al.
2009/0056076 A1 * 3/2009 Goller et al. ..... 16/342
2010/0005628 A1 1/2010 Jung

* cited by examiner

*Primary Examiner* — William Miller
(74) *Attorney, Agent, or Firm* — Pillsbury Winthrop Shaw Pittman LLP

(57) ABSTRACT

A hinge assembly that includes a first hinge member and a second hinge member for mounting to an external vehicle closure member and a vehicle body, a pivot pin, a first clamp member with a first clamp surface, and a second clamp member having a second clamp surface is provided. The pivot pin is pivotally connected to the first hinge member to provide pivotal movement of an external vehicle closure member about a horizontal pivot axis between a closed position and an open position. The first and second clamp members are configured to clamp a mounting portion of the second hinge member between the first and the second clamp surfaces. The mounting portion of the second hinge member has an opening therethrough for receiving the pivot pin and is oversized relative to the pivot pin to accommodate relative radial adjusting movement during installation.

8 Claims, 9 Drawing Sheets

HINGE ASSEMBLY WITH AN ADJUSTABLE PIVOT

BACKGROUND

1. Field

The present disclosure relates to a hinge. More specifically, the present application provides illustrated embodiments of the present disclosure, including those relating to a hinge for use, for example, in a motor vehicle.

2. Description of Related Art

Vehicle closure hinges may have very long members, for example, one member connected to a vehicle body and the other member connected to a vehicle closure member. An interface between these two members may be a very small contact area relative to their overall size, particularly for horizontal vehicle closure members, such as the hood or trunk.

A pivot or hinge pin pivotally connects these two members to one another for opening and closing movements of the vehicle closure member. Very small variations in surfaces of these two members around the pivot or hinge pin may cause a large amount of displacement at the ends of these members.

Each of these members is provided with one or more mounting holes for mounting the corresponding member to the vehicle body or to the vehicle closure member. The location of mounting holes (i.e., the position of vehicle closure member mounting holes relative to vehicle body mounting holes) in these hinges is important because they are used to set the vehicle closure member in the correct position.

The cross-car alignment of the hinge mounting holes is difficult to control, and either requires very accurate members, large tolerances, or manual rework of the members. That is, in order to control the cross-car position of hinge mounting holes, the mating surfaces need extremely tight tolerances on the members that are difficult to manufacture and maintain over time. Current designs generally use a secondary process of net-piercing or manual rework to achieve positional tolerance of mounting holes. Also, current designs generally use tighter tolerances on the members, and large tolerances on the final assemblies. Tighter tolerances make it more difficult to produce the desired accuracy.

There is a need for a hinge that is accurate regardless of the accuracy of the individual members of the hinge.

SUMMARY

In one embodiment of the present disclosure, a hinge assembly that includes a first hinge member for mounting to one of an external vehicle closure member and a vehicle body, a second hinge member for mounting to the other of the external vehicle closure member and the vehicle body, a pivot pin, a first clamp member with a first clamp surface, and a second clamp member having a second clamp surface is provided. The pivot pin is pivotally connected to the first hinge member to provide pivotal movement of the external vehicle closure member about a horizontal pivot axis between a closed position and an open position. The first and second clamp members are configured to clamp a mounting portion of the second hinge member between the first and the second clamp surfaces. The mounting portion of the second hinge member has an opening therethrough for receiving the pivot pin and is oversized relative to the pivot pin to accommodate relative radial adjusting movement during installation. The mounting portion of the second hinge member has a concavo-convex configuration, one of the first and second clamping surfaces has a convex configuration and the other of the first and second clamping surfaces has a concave configuration.

Other objects, features, and advantages of one or more embodiments will become apparent from the following detailed description, and accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
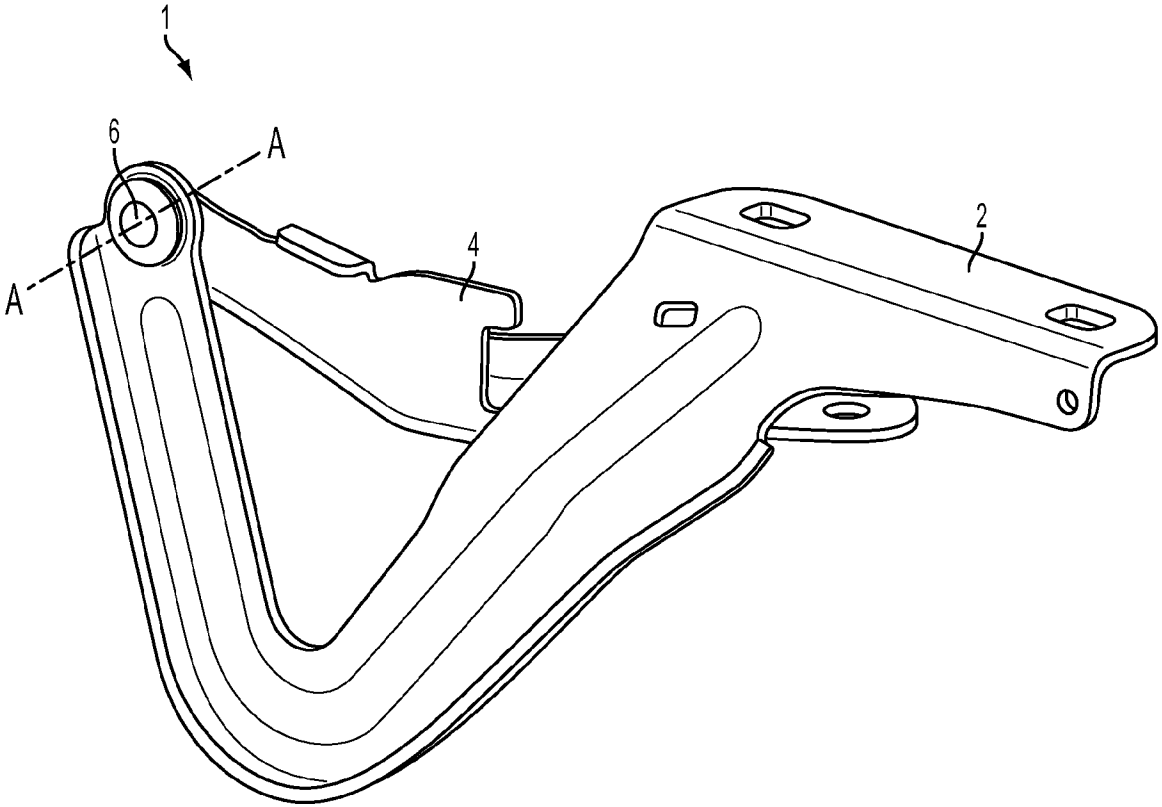
FIG. 1 shows a perspective view of an exemplary hinge assembly for use, for example, in a motor vehicle in accordance with an embodiment of the present disclosure.

FIG. 1 shows an exemplary hinge assembly 1 for use, for example, in a motor vehicle in accordance with embodiment of the present disclosure. The hinge assembly 1 hingedly connects an external vehicle closure member (not shown) of the vehicle to a vehicle body (not shown) for permitting the pivoting of the external vehicle closure member about a horizontal axis A-A to access an inner or rear part of the vehicle.

The external vehicle closure member is a movable panel connected to the vehicle body. The external vehicle closure member is selected from the group consisting of tailgates, liftgates, and decklids. The decklid may be selected from the group consisting of a trunk lid and an engine compartment hood.

Referring to FIG. 1, the exemplary hinge assembly 1 generally includes a first hinge member 2 for mounting to one of the external vehicle closure member and the vehicle body, a second hinge member 4 for mounting to the other of the external vehicle closure member and the vehicle body, and a pivot pin 6 is pivotally connected to the first hinge member 2 to provide pivotal movement of the external vehicle closure member about the horizontal pivot axis A-A between a closed position and an open position. That is, the pivot or hinge pin 6 pivotally connects the first hinge member and the second hinge members 2, 4 to one another for providing opening and closing movements of the external vehicle closure member. One of the first and second hinge members is a vehicle body hinge member and the other of the first and second hinge members is a vehicle external closure hinge member. These hinge members may be formed, for example, using a stamping process. These hinge members may be formed, for example, from a steel sheet material.

Figure 2:
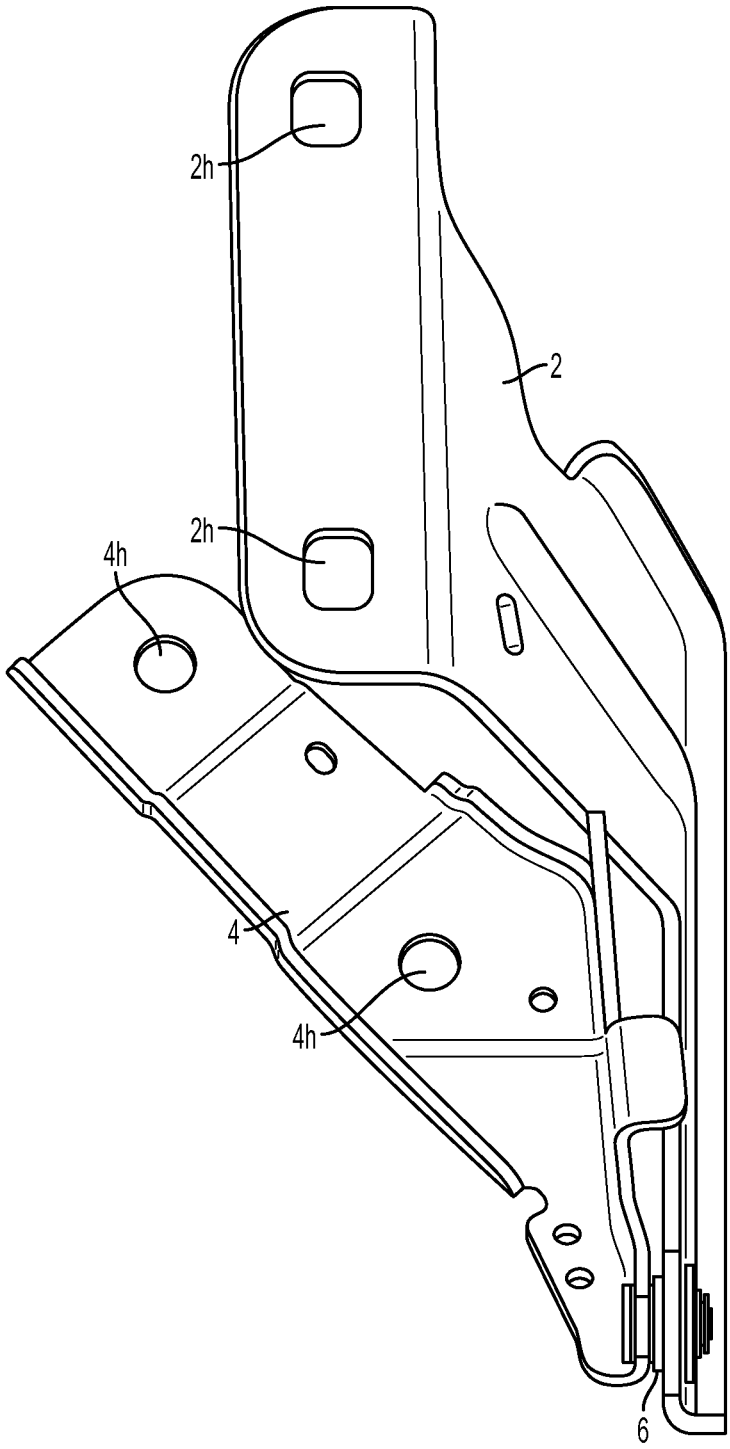
FIG. 2 shows another view of the exemplary hinge assembly shown in FIG. 1.

FIG. 2 shows another view of the exemplary hinge assembly 1 in accordance with an embodiment of the present disclosure in which one or more vehicle closure member mounting holes 2*h* on the external vehicle closure hinge member 2 and one or more vehicle body mounting holes 4*h* on the vehicle body hinge member 4 are shown. The vehicle closure member mounting holes 2*h* and the vehicle body mounting holes 4*h* are used for mounting the vehicle external closure hinge member 2 and the vehicle body hinge member 4 to the vehicle external closure member and the vehicle body, respectively.

Figure 3:
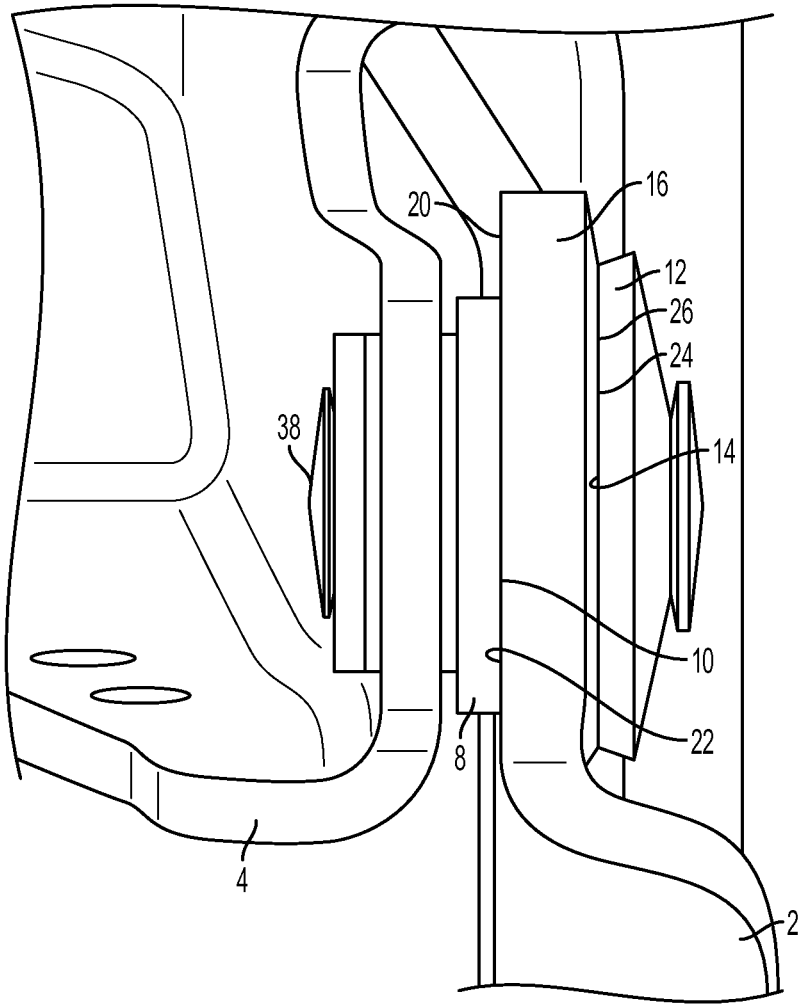
FIG. 3 shows a side view of the hinge assembly in accordance with an embodiment of the present disclosure.
Figure 4:
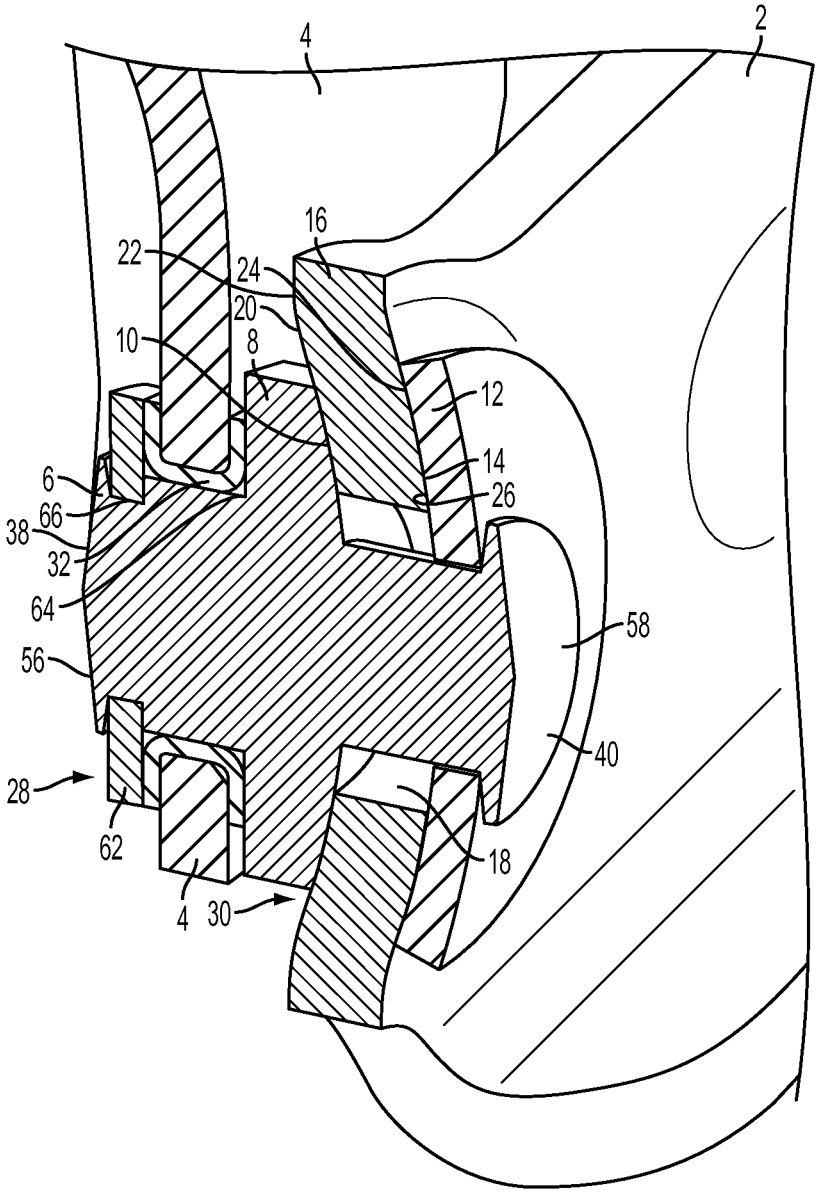
FIG. 4 is a cross-sectional view of the hinge assembly in accordance with an embodiment of the present disclosure.
Figure 5:
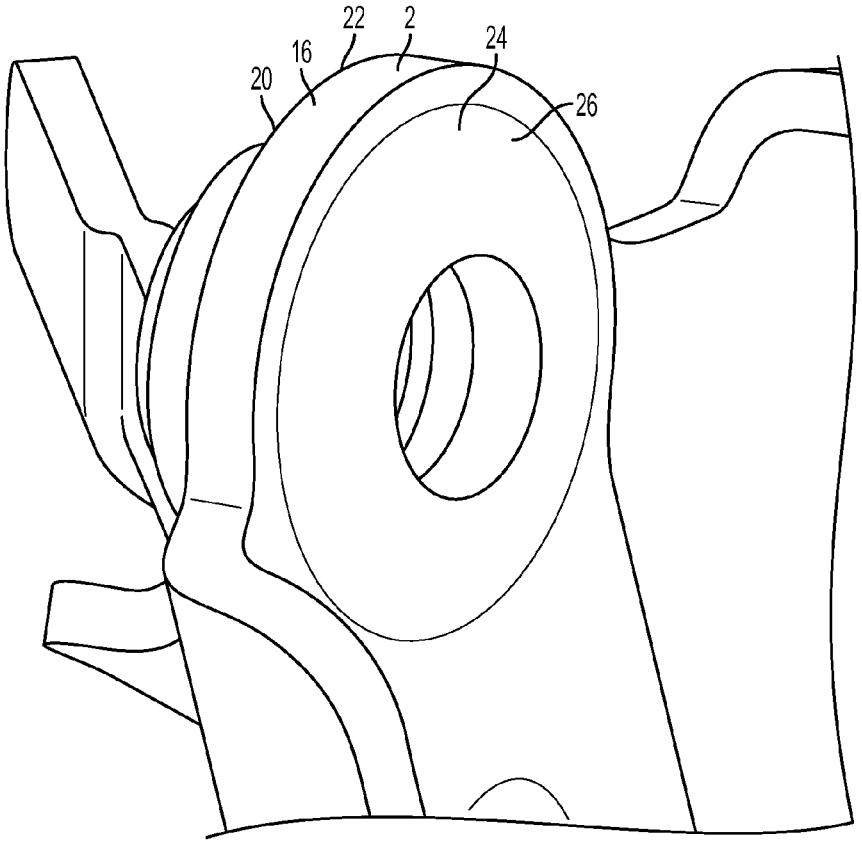
FIG. 5 shows a mounting portion of a second hinge member of the hinge assembly in accordance with an embodiment of the present disclosure.
Figure 6:
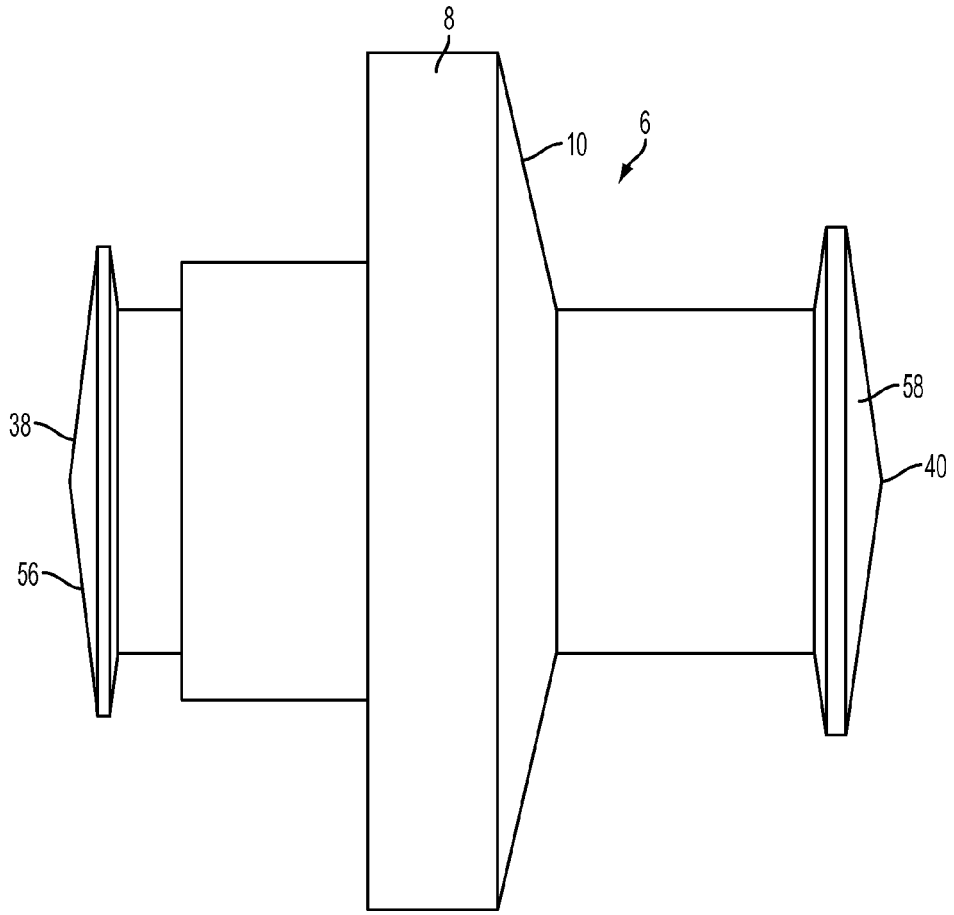
FIG. 6 shows a pivot pin of the hinge assembly in accordance with an embodiment of the present disclosure.

FIGS. 3-6 show various views of the hinge assembly 1 in which FIG. 3 is a side view of the hinge assembly 1 and FIG. 4 is a cross-sectional view of the hinge assembly 1, while FIGS. 5 and 6 show a mounting portion and a pivot pin of the hinge assembly 1, respectively.

The hinge assembly 1 includes a first arrangement 28 and a second arrangement 30.

The first arrangement 28 is configured to allow the hinge assembly 1 to open and close the external vehicle closure member during normal operation. The first arrangement 28 includes the first hinge member 2, the second hinge member 4 and the pivot pin 6 pivotally connected to the first hinge member 2. The first arrangement 28 also includes a washer member 62 and optionally includes a bushing 32. The washer member 62 and the bushing 32 are generally used to connect the second hinge member 4 to the pivot pin 6. The bushing 32 has an opening 64 therethrough for receiving the pivot member 6. The bushing 32 is also configured to receive the vehicle body hinge member 4 therein. The washer member 62 has an opening 66 therethrough for receiving the pivot member 6. The washer member 62 is disposed between the vehicle body hinge member 4 (and the bushing 32 partially surrounding it) and an end 38 of the pivot pin 6.

During assembly, the pivot pin 6 is inserted through the hinge member 4 and the bushing 32 and the washer member 62 is disposed on the end of the pivot member 6. Once the washer member 62 and the vehicle body hinge member 4 are positioned in place, the end 38 of the pivot pin 6 is secured, for example, via riveting. In one embodiment, the washer member 62 and a radially extending portion of the pivot pin 6 apply clamping forces onto side surfaces of the vehicle body hinge member 4. Thus, the vehicle body hinge member 4 is securely connected to the pivot pin 6. Once the hinge assembly 1 is assembled, this first arrangement 28 acts as a normal rotating joint of the hinge assembly 1 with the hinge member 4 pivoting about the pin 6 to open and close the external vehicle closure member.

The second arrangement 30 allows for cross-car position of the external vehicle closure member side mounting holes 2*h* (as shown in FIG. 2) to be adjusted for the hinge assembly 1. Referring to FIGS. 3-6, the second arrangement 30 of the hinge assembly 1 includes a first clamp member 8 with a first clamp surface 10 and a second clamp member 12 having a second clamp surface 14. The first and second clamp members 8, 12 are configured to clamp a mounting portion 16 of the hinge member 2 between the first and the second clamp surfaces 10, 14. The mounting portion 16 has an opening 18 therethrough for receiving the pivot pin 6 and is oversized relative to the pivot pin 6 to accommodate relative radial adjusting movement during installation.

That is, the second arrangement 30 includes a concavo-convex surface configuration formed on one of the first hinge member and the second hinge members 2, 4 that will engage or mate with corresponding surfaces on the first clamp member 8 and the second clamping member 12. The second arrangement 30 is configured to allow for radial adjusting movement between the mounting portion 16 and the pivot pin 6 during installation of the hinge assembly 1.

As shown in FIGS. 3-5, the mounting portion 16 is on the second hinge member 2 and has a concavo-convex configuration. As shown in FIGS. 3 and 5, the mounting portion 16 of the second hinge member 2 has an inwardly curved concave surface 20 on one side 22 and an outwardly curved convex surface 24 on the other side 26. In another embodiment, the inwardly curved concave surface 20 is disposed on the side 26 and the outwardly curved convex surface 24 is disposed on the side 22.

One of the first and second clamping surfaces 10, 14 has a convex configuration and the other of the first and second clamping surfaces 10, 14 has a concave configuration. As shown in FIGS. 3-4, the first clamping surface 10 has a convex surface configuration, while the second clamping surface 14 has a concave surface configuration. In another embodiment, the first clamping surface 10 has a concave surface configuration, while the second clamping surface 14 has a convex surface configuration.

The convex surface 24 of the mounting portion 16 is configured to engage with a concave surface of one of the first and second clamping surfaces 10, 14 and a concave surface 20 of the mounting portion 16 is configured to engage with a convex surface of the other of the first and second clamping surfaces 10, 14 when the mounting portion 16 of the second hinge member 2 is clamped between the first and the second clamp surfaces 10, 14.

In one embodiment, the clamp surfaces 10 and 14 may optionally be textured (e.g., knurled or rings). These textured surfaces provide improved locking of the mounting portion 16 of the second hinge member 2 between the clamp surfaces 10 and 14.

Figure 9:
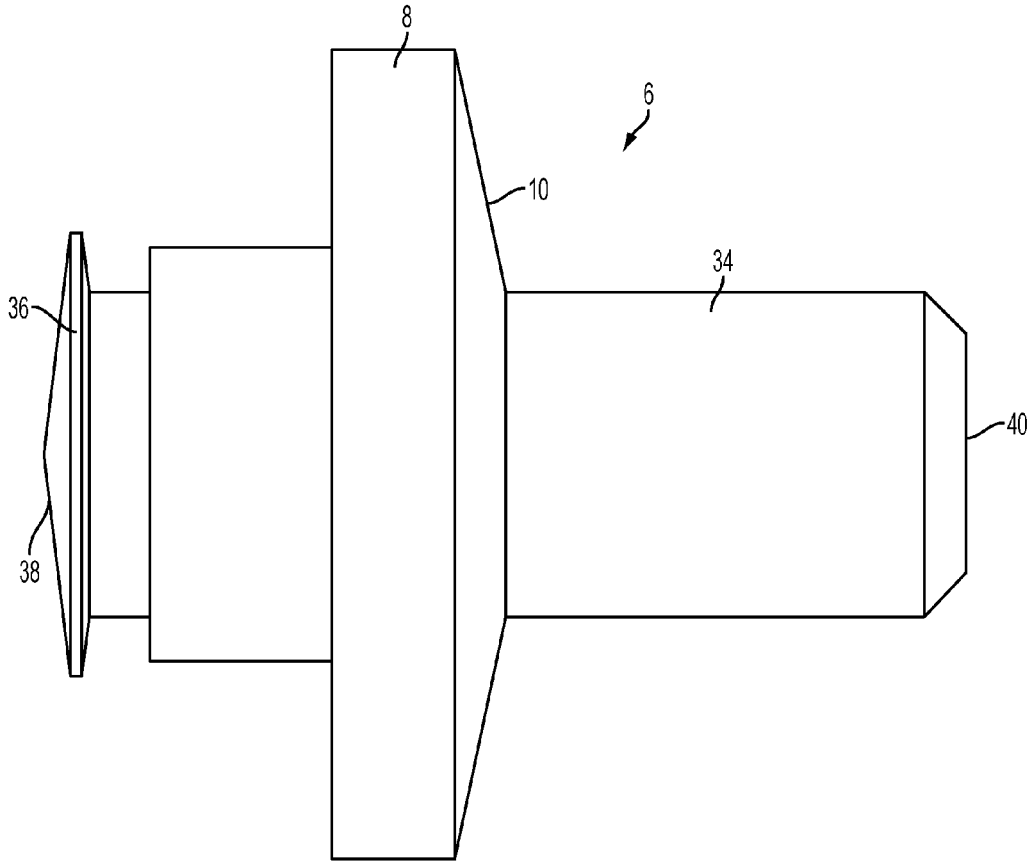
FIG. 9 shows a pivot pin of the hinge assembly in accordance with another embodiment of the present disclosure.

As shown in FIGS. 6 and 9, the first clamp member 8 may be integrally formed with the pivot pin 6. In another embodiment, the first clamp member 8 may be separately formed from the pivot pin 6. In such an embodiment, the separately formed first clamp member may be secured to the pivot pin 6 using any attachment mechanism as will be appreciated by one skilled in the art.

As shown in FIGS. 3-6, the pivot pin 6 includes a riveted design on both its ends. That is, the pivot pin 6 includes a first riveted portion 56 on one end 38 and a second riveted portion 58 on the other end 40. The ends of the pivot pin 6 themselves may be axially compressed and radially expanded to form the riveted heads.

As shown in FIGS. 3-6, the second clamping member 12 may be in the form of a washer member. The washer member 12 is positioned between the mounting member 16 of the second hinge member 2 and the end 40 of the pivot pin 6 to provide the required clamp load. The washer member 12 includes the clamp surface 14. This clamp surface 14, along with the clamp surface 10 of clamp member 8, is configured to clamp the mounting portion 16 of the second hinge member 2 between the first and the second clamp surfaces 10, 14. The surface 14 is designed to fit or match the surface 24 on the side 26 of the mounting portion 16.

The opening 18 in the mounting portion 16 of the second hinge member 2 is radially oversized relative to the pivot pin 6. This stamping gap or opening 18 allows for a certain amount of angular movement of the hinge members 2 and 4 in relation to each other.

During assembly, the vehicle external closure hinge member 2 and the washer (or second clamp) member 12 are disposed on the pivot member 6. Once the washer member 12 and the vehicle external closure hinge member 2 are positioned in place, the end 40 of the pivot pin 6 is secured by either riveting (shown in FIGS. 3-7) or with a nut (shown in FIGS. 8 and 9).

The assembly and operation of the hinge assembly 1 is shown and explained with respect to FIGS. 3-6.

First, the first hinge member and the second hinge members 2 and 4 are placed in their correct position or orientation. That is, the hinge member 4 disposed on the pivot pin 6. The washer member 62 is received between hinge member 4 and the end 38 of the pivot pin 6, and is disposed on the pivot pin 6. Once the washer member 62 and the hinge member 4 are positioned in place, the end 38 of the pivot pin 6 is secured, for example, via riveting (as shown). Other types of fastening, such as C-clips, threaded nuts, etc. may be used. The mounting member 16 of the hinge member 2 and the clamp member 12 are disposed on the pivot pin 6. The mounting member 16 is loosely assembled between the clamp members 8 and 12.

The hinge assembly 1 may then be held in a fixture with the mounting holes 2*h* and 4*h* of the hinge members 2 and 4, respectively, in their nominal positions. With the hinge assembly 1 held in the fixture, the end 40 of the pivot pin 6 is secured either by riveting (as shown in FIGS. 3-7) or by using a nut (as shown in FIGS. 8 and 9). During the assembly, proper mating of the surfaces 20 and 24 of the mounting member 16 and the surfaces 12 and 14 of the clamp members 8 and 10, respectively is ensured. When the pivot pin 6 is secured (via riveting or bolting), the clamp member 12 engages with the surface 24 of the external vehicle closure hinge member 2 and clamps the mounting member 16 of the hinge member 2 between the pivot pin clamp surface 10 and the clamp member 12, thus securing it in position. Any variation in the parts (i.e., the first and the second hinge members 2 and 4) that may cause the mounting holes 2*h*, 4*h* to be out of position is taken up by the oversized opening that allows the hinge member 2 to rotate into the correct position. The assembled hinge assembly 1 is then connected to the vehicle body and the vehicle external closure member via fasteners passing through the mounting holes 2*h* and 4*h* of the hinge members 2 and 4.

The hinge assembly 1 of the present disclosure allows the vehicle closure hinge to be set in the exact position and then be locked down in that position. This ensures that the vehicle closure hinge is accurate regardless of the accuracy of the individual stamped vehicle members (i.e., the first and second hinge members 2 and 4). Also, the hinge assembly 1 disclosed in the present disclosure allows the cross-car position of the mounting holes 2*h* and 4*h* to be set in a fixture and then locked into position, thereby ensuring accurate hole locations. The hinge assembly 1 disclosed in the present disclosure also ensures that the mounting planes on which the mounting holes 2*h* and 4*h* are located are positioned relative to each other so as to achieve tighter tolerances (profile control).

Figure 7:
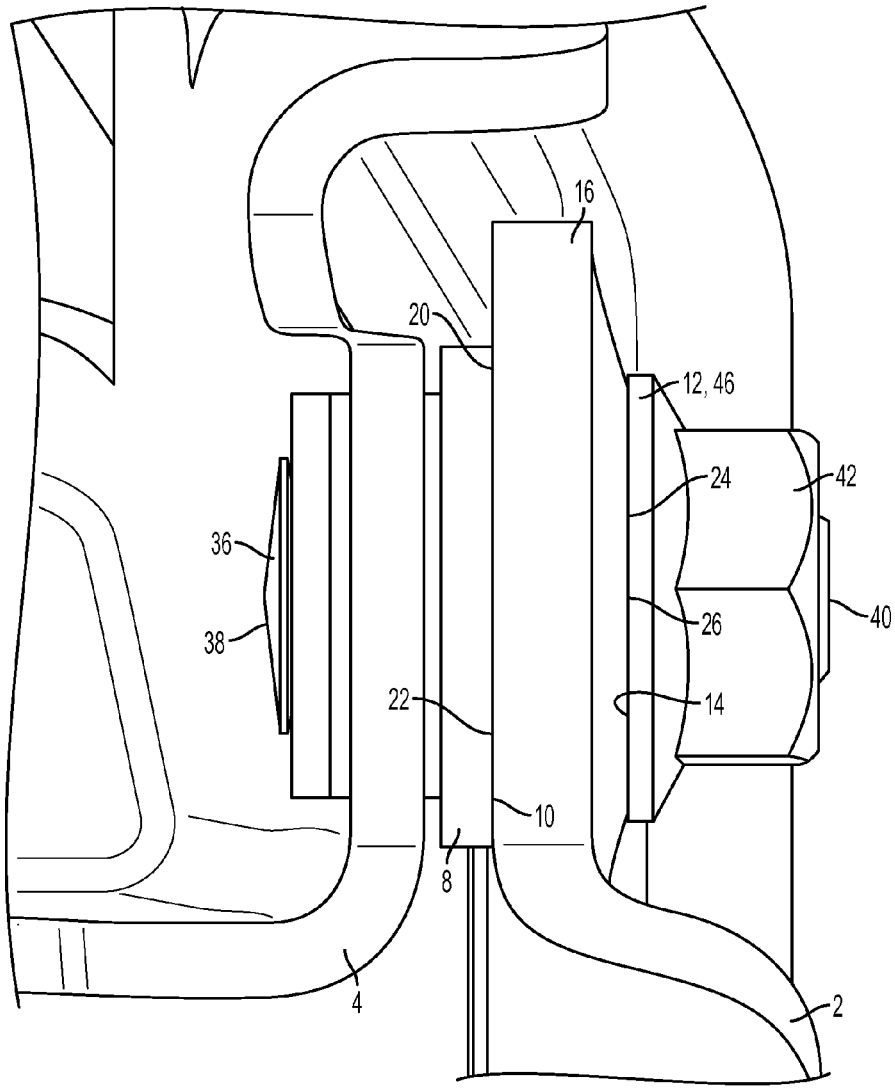
FIG. 7 shows a side view of the hinge assembly in accordance with another embodiment of the present disclosure.
Figure 8:
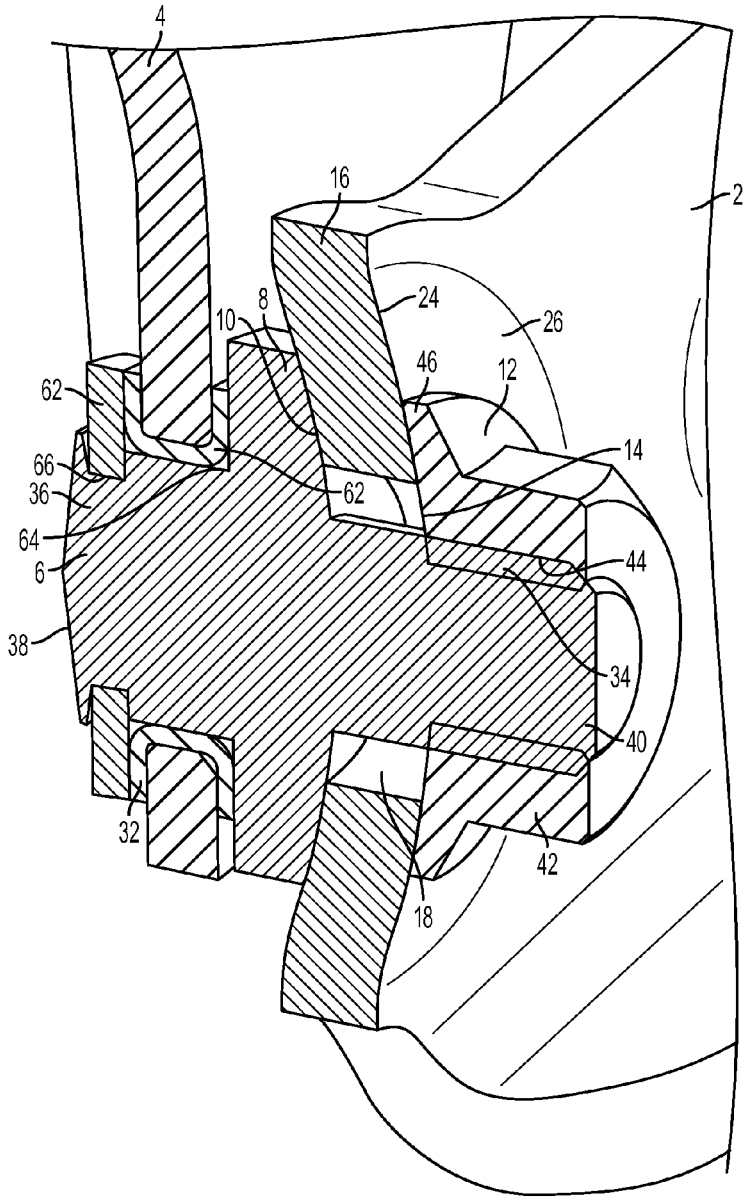
FIG. 8 is a cross-sectional view of the hinge assembly in accordance with another embodiment of the present disclosure.

FIGS. 7 and 8 show another embodiment of the hinge assembly 1. The structure, assembly and operation of the hinge assembly 1 (shown in FIGS. 8 and 9) is same as the hinge assembly shown in FIGS. 3 and 4, except for the differences noted below.

As shown in FIGS. 7 and 8, the pivot pin 6 includes a bolted design at end 40 thereof. That is, the pivot pin 6 includes the riveted portion 36 on one end 38 and a threaded portion 34 on the other end 40. The hinge assembly 1 also includes a complementary nut 42 having a threaded portion 44 that engages with the threaded portion 34 of the pivot pin 6. In one embodiment, one of the threaded portions 34 and 44 has an external threaded portion and the other of the threaded portions 34 and 44 has an internal threaded portion.

As shown in FIGS. 7 and 8, the complementary nut 42 acts as the second clamp member 12. The complementary nut 42 may be a flange nut that includes a base portion 46. The base portion 46 of the flange nut 42 includes the clamp surface 14. This clamp surface 14, along with the clamp surface 10 of clamp member 8, is configured to clamp the mounting portion 16 of the second hinge member 2 between the first and the second clamp surfaces 10, 14. The surface 14 of the base portion 46 of flange nut 42 is designed to fit or match the surface 24 on side 26 of the mounting portion 16. This bolted design allows for any re-adjustment if necessary.

In another embodiment, the base portion 46 may be separate from the nut 42. In such an embodiment, the base portion 46 may be in the form of a washer member. For example, if the flange nut 42 doesn't have a large enough surface area to provide the required clamp load, a washer member may be used to provide the required clamp load. The surface 14 of the washer member is designed to fit or match the surface 24 on side 26 of the mounting portion 16.

The hinge assembly 1 of the present application eliminates the effect of part variation on the final assembly that is caused by the individual stamped vehicle members of the hinge assembly 1. The hinge assembly 1 of the present application allows greater tolerances on the stamped vehicle members, since the second arrangement 30 can accommodate the part variation. The hinge assembly 1 allows each part to be set into the exact customer required position. The hinge assembly 1 of the present application also allows for tighter tolerances to the customer, which in turn lead to improved external vehicle closure member that fits in the vehicle. The hinge assembly 1 of the present application also avoids the cost associated with the secondary steps or procedures (e.g., net-piercing or manual rework used to achieve positional tolerance of mounting holes) preformed to the final assemblies.

The hinge assembly of the present disclosure is intended for use in any system with a single pivot geometry. For example, the hinge assembly of the present disclosure may be used for single pivot hood hinges or single pivot decklid hinges in vehicles.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the present disclosure following, in general, the principles of the present disclosure and including such departures from the present disclosure as come within known or customary practice in the art to which the present disclosure pertains, and as may be applied to the essential features hereinbefore set forth and followed in the spirit and scope of the appended claims.

What is claimed is:

1. A hinge assembly comprising:

a first hinge member for mounting to one of an external vehicle closure member and a vehicle body;

a second hinge member for mounting to the other of the external vehicle closure member and the vehicle body;

a pivot pin pivotally connected to the first hinge member to provide pivotal movement of the external vehicle closure member about a horizontal pivot axis between a closed position and an open position;

a first clamp member with a first clamp surface; and a second clamp member having a second clamp surface, wherein the first and second clamp members are configured to clamp a mounting portion of the second hinge member between the first and the second clamp surfaces, wherein the mounting portion of the second hinge member has an opening therethrough for receiving the pivot pin and being oversized relative to the pivot pin to accommodate relative radial adjusting movement during installation, and wherein the mounting portion of the second hinge member has a concavo-convex configuration having a convex surface and a concave surface, one of the first and second clamping surfaces has a convex configuration and the other of the first and second clamping surfaces has a concave configuration.

2. The hinge assembly of claim 1, wherein the convex surface of the mounting portion is configured to engage with a concave surface of the concave configuration of one of the first and second clamping surfaces and the concave surface of the mounting portion is configured to engage with a convex surface of the convex configuration of the other of the first and second clamping surfaces when the mounting portion of the second hinge member is clamped between the first and the second clamp surfaces.

3. The hinge assembly of claim 1, wherein the pivot pin is integrally formed with one of the first and second clamping surfaces.

4. The hinge assembly of claim 1, wherein the pivot pin is separate from the first and second clamping surfaces.

5. The hinge assembly of claim 1, wherein one of the first and second clamping surfaces includes a washer and a nut assembly.

6. The hinge assembly of claim 1, wherein one of the first and second clamping surfaces includes a washer and a riveted portion of the pivot pin.

7. The hinge assembly of claim 1, wherein the external vehicle closure member is selected from the group consisting of tailgates, liftgates, and decklids.

8. The hinge assembly of claim 7, wherein the decklid is selected from the group consisting of a trunk lid and an engine compartment hood.

* * * * *